United States Patent [19]

Naylor

[11] Patent Number: 4,566,265

[45] Date of Patent: Jan. 28, 1986

[54] TEXTILE PROCESSING APPARATUS

[75] Inventor: Geoffrey Naylor, Macclesfield, United Kingdom

[73] Assignee: Rieter-Scragg Limited, Cheshire, United Kingdom

[21] Appl. No.: 631,175

[22] Filed: Jul. 16, 1984

[30] Foreign Application Priority Data

Aug. 6, 1983 [GB] United Kingdom ..... 8321249
Feb. 16, 1984 [GB] United Kingdom ..... 8404066

[51] Int. Cl.[4] ..... D02G 1/04

[52] U.S. Cl. ..... 57/336; 57/105; 57/348

[58] Field of Search ..... 57/331, 336, 334, 348, 57/349, 104, 105

[56] References Cited

U.S. PATENT DOCUMENTS 2,908,133 10/1959 Brown ..... 57/336
3,045,416 7/1962 Ubbelohde ..... 57/336 X
3,103,097 9/1963 Meili et al. ..... 57/336
4,144,700 3/1979 Takai et al. ..... 57/336 X
4,248,038 2/1981 Takai ..... 57/336

FOREIGN PATENT DOCUMENTS 53-83737 7/1978 Japan .

*Primary Examiner*—John Petrakes
*Attorney, Agent, or Firm*—Oblon, Fisher, Spivak, McClelland & Maier

[57] ABSTRACT

Apparatus for twisting a running yarn in a textile machine comprises first and second pulleys mounted for rotation about parallel axes and an endless belt passing around their aligned peripheries so as to provide two runs each of which is twisted through 180° and crosses the other run to form a nip region therewith through which the yarn is guided by yarn guides. One pulley, which may be of larger diameter than the other driven pulley, is mounted on a pivoted arm to tension the belt and/or allow for the use of differing sized belts or differing sized pulleys to alter the crossing angle of the belt and the twist level applied to the yarn.

18 Claims, 5 Drawing Figures

TEXTILE PROCESSING APPARATUS

BACKGROUND OF THE INVENTION

1. Field of the Invention

This invention relates to textile processing apparatus and in particular to apparatus in use of which a textile yarn, sliver or roving (herein after referred to as yarn) is spun or twisted by being passed in contact with one or more surfaces which is or are moving in a direction transverse to the forwarding direction of the yarn.

2. Description of the Prior Art

A process as described above is known as friction spinning or twisting and various types of apparatus are known for performing this process. For example in the false twisting art a yarn may be passed over the edge of one or more rotating discs and apparatus using this principle is described in British Pat. Nos. 1381132, 1419085, 1419086, 1456655, and 1475698. It is also known to pass a yarn between two discs which are in face-to-face disposition and rotating in opposite directions, or between two moving belts which run in directions inclined to each other and to the direction of forward movement of the yarn. An example of false twist apparatus using this latter principle is described in British Patent Publication No. 2102844A.

SUMMARY OF THE INVENTION

It is with friction spinning or twisting apparatus of this latter type that the present invention is concerned, and it is an object of the present invention to provide an improved apparatus of this type and one in which the disadvantages experienced with known apparatus of this type; such as belt overheating and wear, size and complication of the apparatus, difficulty of changing the belt crossing angle to cater for differing desired twist insertion, accuracy of locating the yarn with respect to the belt nip position; are avoided or at least substantially reduced.

The invention provides apparatus for twisting a running yarn comprising first and second pulleys mounted for rotation about spaced substantially parallel axes with their peripheries lying substantially in mututal alignment, means for driving said first pulley in rotation, an endless belt passing around said peripheries so as to provide two runs each of which is twisted through substantially 180 degrees and crosses the other of said runs to form a nip therewith as it passes between said peripheries, and guide means for guiding a running yarn between said belt runs in the region of said nip.

Said first pulley may be mounted on a support structure and the said second pulley may be mounted on said support structure so as to be movable towards and away from said first pulley. Preferably said second pulley is mounted on an arm which is pivotally mounted on said support structure. Biassing means may be provided whereby said pivoted arm may be resiliently biassed in a direction away from said first pulley.

The guide means may be mounted on said support structure so as to be positionally adjustable towards or away from said first pulley, whereby belts of differing length may be accommodated in said apparatus. In this case the biassing means may be mounted on said support structure so as to be movable with said guide means and said biassing means may apply a force to said pivoted arm at a point which, in the case of said first and second pulleys being of equal diameter, is substantially equidistant from the pivot axis of said pivoted arm and the axis of rotation of said second pulley.

The apparatus may include a third pulley mounted for rotation about a third axis spaced from and substantially parallel with the axes of said first and second pulleys and having its periphery substantially in alignment with the peripheries of said first and second pulleys. Said endless belt may pass around the peripheries of said three pulleys.

Said third pulley may be mounted on said support structure so as to be movable towards and away from said first and second pulleys. Preferably said third pulley is mounted on a second arm which is pivotally mounted on said support structure, said biassing means may be operable to resiliently bias said pivoted second arm in a direction away from said first and second pulleys.

The second pulley may be of larger diameter than said first pulley, and the guide means may be disposed so as to guide said yarn between said belt runs in the region of said nip substantially parallel with but spaced from the centre-line of said nip region towards said second pulley.

The apparatus may also comprise belt steadying means, preferably located adjacent said nip. Said steadying means may comprise a pin mounted on said support structure and positioned whereby an edge of said belt contacts said pin when the belt is running but there is no contact therebetween when said belt is stationary.

Preferably the biassing means comprises adjustment means whereby the tension in the belt may be adjusted to cater for yarns of differing deniers.

The drive means may comprise a drive shaft rotatably mounted in said support structure, a wharve on said shaft whereby said wharve may be driven by contact with an endless machine drive belt, a first drive pulley on said shaft, a second drive pulley on a spindle on which said first pulley is mounted and an endless apparatus drive belt passing around said first and second drive pulleys. Preferably said first and second drive pulleys are toothed pulleys and said apparatus drive belt is a toothed timing belt. Said drive shaft and said spindle may have axes which extend in mutually substantially perpendicular directions, in which case said timing belt provides two runs thereof each of which is twisted through substantially 90 degrees. The drive pulleys are preferably disposed relative to each other whereby the mid-axial plane of each drive pulley is substantially tangential to the periphery of the other drive pulley at that side thereof at which the apparatus drive belt is disengaged therefrom.

Cam means may be provided, operable to increase the force appliedby said biassing means after start up of the yarn twisting process by said apparatus.

The invention also provides a textile machine having a plurality of yarn processing stations, and at each station a supply of yarn to be processed, first feed means operable to withdraw a yarn from said supply, a heater, cooling means, a yarn twisting apparatus as aforesaid, a second feed means and yarn take-up means. The textile machine may also comprise, for each processing station and after said second feed means, a second heater and third feed means. The machine may also comprise yarn breakage detection means which may be operable on detection of a yarn break to activate said cam means to cause a reduction in the force applied by biassing means to a pivoted arm on which one of said pulleys is mounted to reduce tension in the endless belt.

DESCRIPTION OF THE DRAWINGS

The invention will now be further described with reference to accompanying drawings in which.

DETAILED DESCRIPTION OF THE PREFERRED EMBODIMENTS

Figure 1:
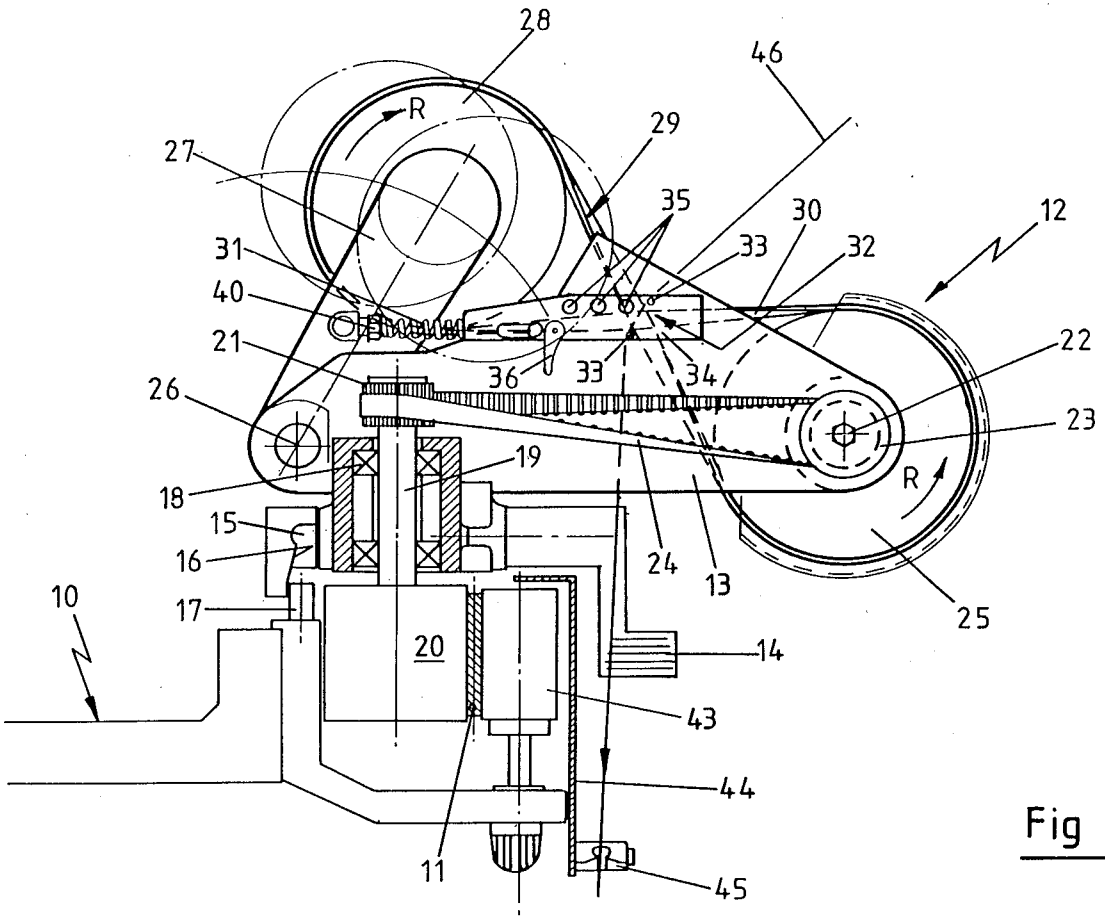
FIG. 1 is a side elevation, partly in section of a first embodiment

Referring now to FIG. 1 there is shown a part of a textile machine 10 which comprises a plurality of like yarn processing stations, only one being shown for clarity. Lengthwise of the machine 10 runs an endless machine drive belt 11 for driving the yarn twisting apparatus 12 located at each yarn processing station. At each processing station the belt 11 is guided and supported by an idler roller 43 which is shielded by a guard 44. Mounted on the guard 44 is a yarn guide 45 through which a yarn 46 is guided to second feed means (not shown) and yarn take-up means (not shown), and optionally a second heater and third feed means (also not shown).

The yarn twisting apparatus 12 comprises a support structure 13 which is pivotally mounted on the textile machine 10 and a lever 14 is rotatably mounted on a shaft 15 passing through support structure 13. A cam surface 16 is provided on shaft 15 to cooperate with a spigot 17 on the machine 10 so that rotation of lever 14 causes pivotal movement of the support structure 13 relative to machine 10, and against the force of a spring (not shown), between operative and non-operative positions. Rotatably mounted in bearings 18 in support structure 13 is a drive shaft 19 on one end of which is a wharve 3. In the operative position of the support structure 13 the wharve engages the drive belt 11, whilst these are disengaged when the lever 14 is rotated to cause the support structure to move to the in-operative position.

At the other end of drive shaft 19 is a toothed pulley 21. Rotatably mounted in the support structure 13 is a spindle 22 on which a second toothed pulley 23 is mounted, the axis of spindle 22 being perpendicular to that of drive shaft 19. A timing belt 24 engages the two toothed pulleys 21, 23 and each run of timing belt 24 is twisted through 90 degrees. In order that correct and smooth running of belt 24 is ensured the mid-axial plane of pulley 21 is, as can be seen in FIG. 1, tangential to the periphery of pulley 23 at the point at which the timing belt 24 leaves that periphery. Similarly the mid-axial plane of pulley 23 is tangential to the periphery of pulley 21 at the point at which the timing belt 24 leaves the periphery of pulley 21. With such alignment the timing belt 24 runs correctly and smoothly in an anticlockwise direction as viewed in FIG. 1, and one pulley 25 which is mounted on spindle 22 also rotates in an anticlockwise direction as shown by arrow 'R' indicated thereon.

Mounted on support structure 13 for pivotal movement about axis 26 is an arm 27 which carries another pulley 28. Pulleys 25 & 28 rotate about parallel axes and have their peripheries in mutual alignment (see FIG. 4). A belt 29 passes around the peripheries of pulleys 25, 28 and serves to drive pulley 28. The runs of belt 29 between the pulleys 25, 28 are each twisted through 180 degrees so that one face 30 of belt 29 successively passes around and in contact with pulley 25, itself and yarn 46, pulley 28 and then itself and yarn 46 again.

Since the same surface 30 of belt 29 serves to insert twist into yarn 46 by contact therewith and then passes in contact with the peripheral surfaces of pulleys 25, 28, the heat generated by the frictional contact with the yarn 46 by belt 29 is rapidly dissipated to the pulleys 25, 28. Inconsequence the belt 29 runs at a lower temperature than is the case with known belt twisting apparatus in which the surface which contacts the yarn is opposed to that which contacts the pulley peripheries. To increase the cooling effect on the belt 29 by the pulleys 25, 28 the pulleys themselves may be cooled by having heat dissipating fins or the like (not shown) on their side faces, or they may be cooled by providing a cooling air stream.

The pressure applied to yarn 46 by the belt 29 is dependent upon the tension in the belt 29 and this provides a very convenient way in which the belt to yarn pressure may be adjusted to a desirable value without the need for additional pressure regulating devices. To provide a desired belt tension the arm 27 is acted upon by a compression spring 31 which biasses arm 27 in a direction away from pulley 25. In the case that the apparatus 12 is used for false twisting a yarn, the yarn 46 is withdrawn from a supply (not shown) by first feed means (not shown) and passes through a heater and cooling means (not shown) to be fed to the nip 32 formed between the two runs of belt 29. Yarn guides 33 are positioned on the upstream and downstream sides of nip 32 so as to align the yarn 46 substantially along the bisector of the included angle between the belt runs at the nip 32 since pulley 25 is driven in an anti-clockwise direction as shown by arrow 'R'. The two runs of the belt 29 travel in a downwards direction and false twist the yarn 46 whilst tending to forward it in a downwards direction. In the arrangement as shown in FIG. 1 a Z-twist will be applied to the yarn 46 as it passes through the heater and cooling means. In order to change the hand of twist and apply an S-twist thereto it is simply a matter of removing belt 29 and replacing it with, before replacement, the opposite hand of twist being applied to belt 29 than that shown in FIG. 1. The pulleys 25, 28 rotate in the same direction in both cases, and no reversing of the drive to pulley 25 is required.

In order to alter the twist level applied to yarn 46 a belt 29 of different length from that shown in FIG. 1 is used. This will alter the spacing of pulleys 25 and 28, and hence the included angle between the runs of belt 29. This will provide that there is a greater component of belt velocity transverse to the direction of motion of yarn 46 through nip 32 and a smaller component along that direction, or viceversa, depending upon whether a longer or shorter belt respectively is used. In such a case, since pulleys 25 and 28 are of equal diameter, the nip 32 will move away from or towards pulley 25 by an amount equal to half of that moved by pulley 28, and guides 33 are moved accordingly. Guides 33 are mounted on a guide block 34 which can be positioned in any one of several predetermined locations 35 on support structure 13 corresponding with the chosen length of belt 29. One end of spring 31 also moves by half of the distance moved by pulley 28, and since the other end of spring 31 is connected to arm 27 at a point midway between pivot axis 26 and the axis of rotation of pulley 28, the compressive force in spring 31 remains the same for each length of belt 29 chosen. Preferably the belts 29 of different length are colour coded for rapid recognition in correspondence with the twist level for which each belt is to be used.

Figure 2:
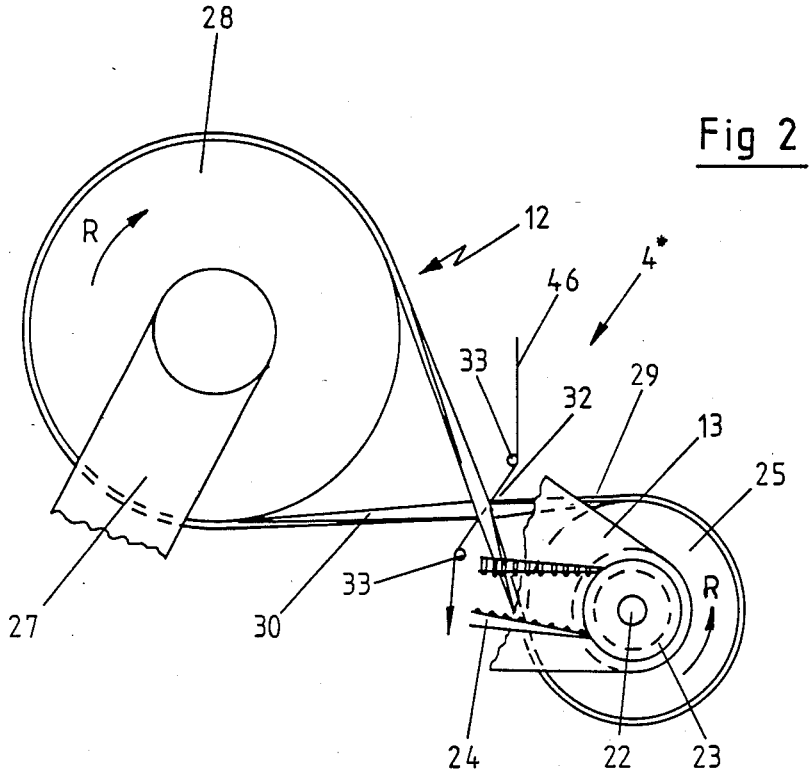
FIG. 2 is a scrap view corresponding with FIG. 1 of a second embodiment.
Figure 4:
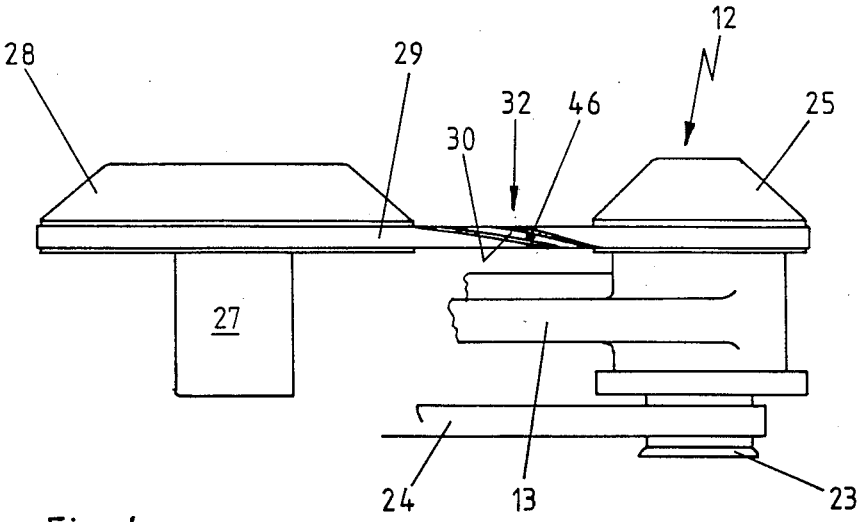
FIG. 4 is a scrap view in the direction of arrow 4* of FIG. 2.
Figure 3:
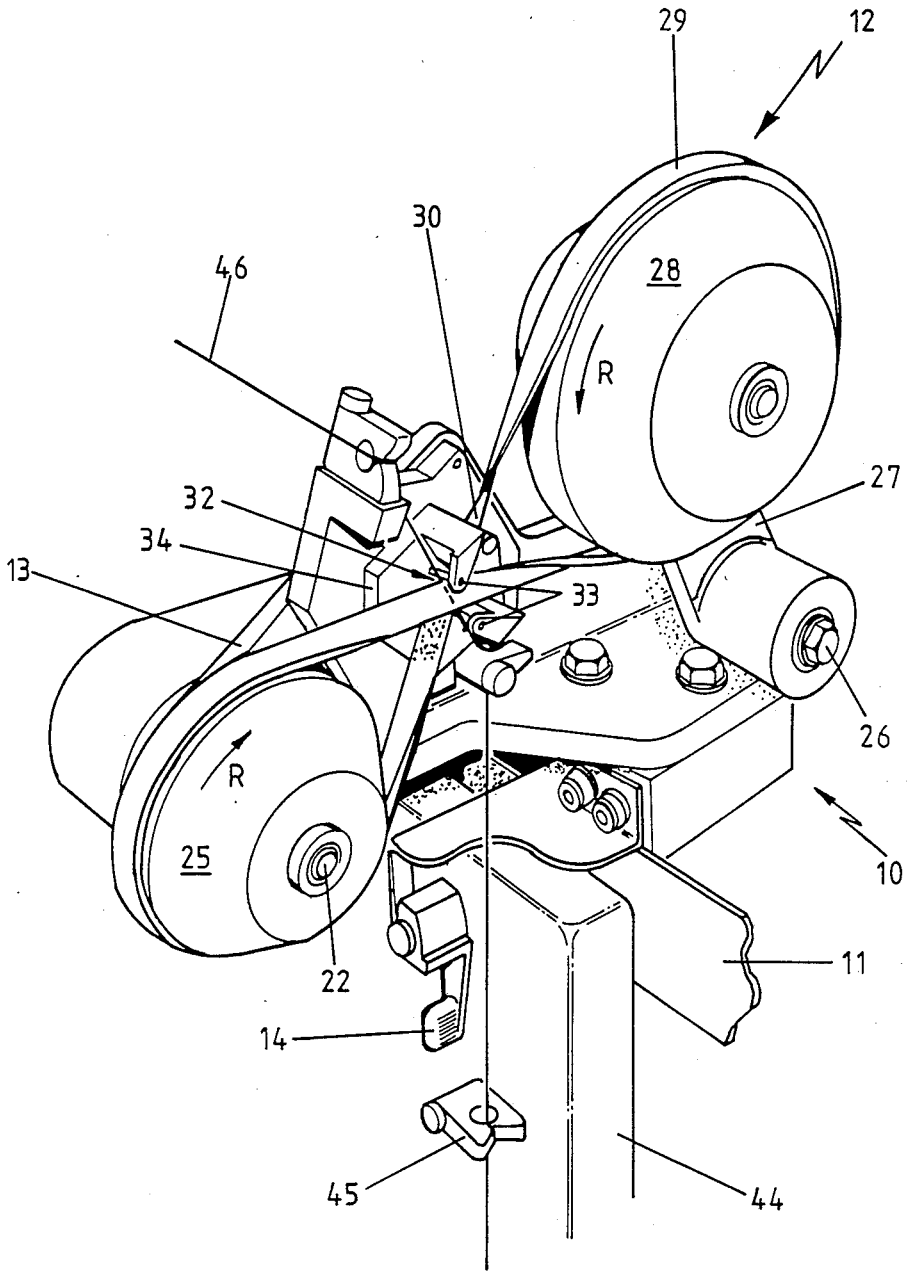
FIG. 3 is a perspective view of the embodiment of FIG. 1 from the opposite side.

Referring now to FIGS. 2 to 4 there is shown an embodiment which is generally similar to that described above except in that in this case pulley 28 is of greater diameter than pulley 25, whereas in the previous embodiment the pulleys were of equal diameter. In this embodiment therefore the nip 32 is displaced from midway between pulleys 25 and 28 to a point nearer to the smaller diameter pulley 25. Such an arrangement serves to alter the wedge formation between the surface 30 of the two runs of belt 29, from being symmetrical in the previous embodiment to being increased at the side facing large pulley 28. This gives a greater length of belt overlap of substantially parallel faces 30 so that the positioning of the yarn 46 in the nip 32 is less critical than was the case in the previous embodiment in order to obtain line rather than point contact between the faces 30 and the yarn 46. The increase in length of the inter belt wedge at the side of the nip nearer the larger pulley is caused by a reduction in the wedge angle at that side.

To facilitate start-up of the false twist process and reduce the tendency for filament breakage or the like a cam 36 (see FIG. 1) is provided in the mounting of spring 31 on the guide block 34. This enables a low belt tension, and hence low belt to yarn pressure, to be selected during start-up and thereafter cam 36 may be rotated to move spring 31 away from pulley 25 to increase the belt tension and the belt to yarn pressure. The cam 36 may be released to reduce the belt tension automatically when a yarn breakage is detected.

Figure 5:
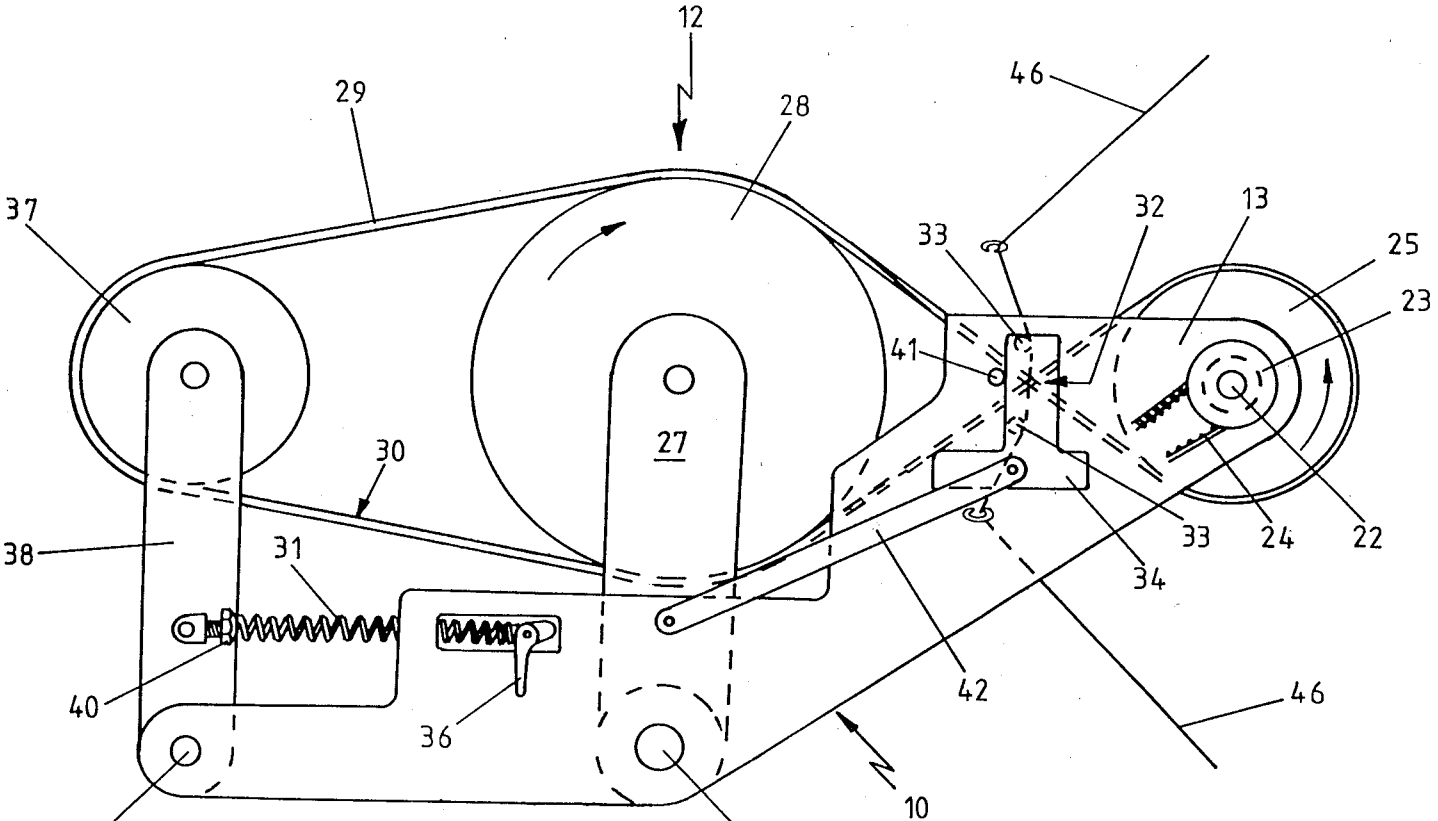
FIG. 5 is a side elevation of a third embodiment.

Referring now to FIG. 5 there is shown a yarn twisting apparatus 12 mounted in a textile machine 10. The apparatus 12 comprises first and second pulleys 25, 28 mounted on a support structure 13. First pulley 25 is driven by means of a toothed belt 24 passing round a drive pulley 23 which is mounted on a common shaft 22 with first pulley 25. The endless belt 29 passes around first and second pulleys 25 and 28 so as to drive the latter. The belt 29 also passes around a third pulley 37, which is mounted on an arm 38 pivotally mounted on the support structure 13. Arm 38 can pivot about axis 39 which is parallel with axis 22 about which first pulley 25 rotates and the axis about which second pulley 28 rotates, and a compression spring 31 biasses arm 38 away from pulleys 25, 28 to tension belt 29. A cam lever 36 is operable to increase the tension in belt 29 after start up of the twisting of yarn 46 by the apparatus 12 on the manner previously described in relation to the embodiments of FIGS. 1 to 4. In addition in all of the embodiments herein described a screw adjustment device 40 is provided whereby the spring force, and therefore the belt tension, can be increased or decreased having regard to the denier of the yarn 46 being twisted. For fine denier yarns the belt tension need not be as high as that required for heavy denier yarns, so that in the former case less belt run to belt run friction will occur, and less heat will be generated than would otherwise occur.

A steady pin 41 is mounted on the support structure 13 adjacent the belt crossing region 32, and is so located that no contact occurs of the belt 29 by pin 41 when the belt 29 is stationary. As can be ascertained in FIG. 4 the motion of the runs of the belt 29 causes a friction force there between which in turn causes the belt runs to move downwardly slightly from their static position so as to bring the edge of belt 29 just in contact with the pin 41 when the belt is running. By this means vibrations of the running belt 29 may be eliminated or substantially reduced so as to produce more even false twisting of the yarn 46. This is of particular significance when fine denier yarns are being processed when there is more belt run to belt run contact than occurs with heavy denier yarns. Such an adjustment of the steady pin 41 has the advantage that there is less friction between the belt 29 and pin 41, and hence less heat generation or wear, then would be the case if the belt 29 and the pin 41 were in contact also when the belt 29 is stationary.

The yarn guides 33 are positioned to guide the yarn 46 through the nip 32 substantially parallel with but spaced from the centreline of the belt crossing region 32 towards the larger pulley 28.

By this means more stable running of the belt 29 and the yarn 46, and greater torque transmission from belt to yarn is achieved than is achieved with the yarn passing along the centreline of the belt crossing region 32. A displacement of a few, e.g. one or two, millimetres from the centreline is beneficial in these respects.

In the cases of the previous embodiments described herein it is proposed that the crossing angle of the belt 29 be changed by changing the belt 29 to one of longer or shorter length as required. Alternatively the same effect can be produced by changing one or both pulleys 25, 28 for one or ones of differing diameter. Movement of arm 27 under the force of spring 31 will accomodate the change of pulley diameter(s) and restore the tension of belt 29 to that required.

In the embodiment of FIG. 5 the pulleys 25 and 28 can also be changed for pulleys of differing diameters. If both pulleys 25, 28 are changed, i.e. two larger or two smaller pulleys 25, 28 are substituted, then the runs of belt 29 will be respectively more aligned with or more transverse relative to the direction of motion of the yarn 46 through the nip 32, whilst the nip 32 will remain in the same position. Again movement of arm 38 under the force of spring 31 will accomodate the change of the pulley diameters and restore the tension of belt 29 to that required.

Alternatively the belt crossing angle may be adjusted by pivoting arm 27 on which pulley 17 is mounted towards or away from pulley 25.

Since in this embodiment and in that of FIGS. 2 to 4 the nip 32 is distanced from the centres of the pulleys 25,28 by amounts proportional to the respective pulley diameter, movement of the nip 32 will be equal to the distance moved by the centre of pulley 28 multiplied by the ratio of the smaller to the sum of the pulley diameters. In consequence in this embodiment a link 42 is provided connecting guide block 34 with a point on arm 27 distanced from pivot axis 26 and the centre of pulley 28 by amounts proportional to the diameters of pulleys 25 and 28 respectively, whereas in the embodiment of FIGS. 2 to 4 the spring 31 applies its force to such a point. In either case yarn guides 33 are mounted on slide 34, and preferably belt steady pin 41 also may be mounted on slide 34 so as to retain its positional relationship with the nip 32 when the belt crossing angle is changed in this way.

We claim:

1. Apparatus for twisting a running yarn comprising a support structure, first and second pulleys mounted on said support structure for rotation about spaced, substantially parallel respective first and second axes and each having a periphery lying substantially in alignment with the periphery of the other pulley, means for driving one of said pulleys in rotation, an endless belt passing around said peripheries so as to provide two runs each of which is twisted through substantially 180° and crosses the other of said twisted runs to form a nip therewith as it passes between the peripheries of said first and second pulleys, guide means for guiding a running yarn between said twisted belt runs in the region of said nip, an arm pivotally mounted on said support structure to pivot about a pivot axis thereof and on which one of said pulleys is mounted, biassing means operable to bias said arm in a direction away from the other pulley, said biassing means applying a force to said arm at a point spaced from said pivot axis and the axis of rotation of the pulley mounted on said arm by distances proportional to the diameters of said first and second pulleys.

2. Apparatus for twisting a running yarn comprising a support structure, first and second pulleys mounted on said support structure for rotation about spaced, substantially parallel respective first and second axes and each having a periphery lying substantially in alignment with the periphery of the other pulley, an endless belt passing around said peripheries so as to provide two runs each of which is twisted through substantially 180° and crosses the other of said twisted runs to form a nip therewith as it passes between the peripheries of said first and second pulleys, guide means for guiding a running yarn between said twisted belt runs in the region of said nip, and means for driving a driven one of said pulleys in rotation comprising an endless machine drive belt and a spindle on which said driven pulley is mounted, a shaft rotatably mounted in said support structure, a wharve on said shaft whereby said wharve may be driven by contact with said machine drive belt, a first drive pulley on said shaft, a second drive pulley on said spindle and an endless apparatus drive belt passing around said first and second drive pulleys.

3. Apparatus according to claim 1, wherein said second pulley is of larger diameter than said first pulley.

4. Apparatus according to claim 3, wherein said nip region has a centreline and said guide means are disposed so as to guide said yarn between said belt runs in the region of said nip substantially parallel with but spaced from said centreline towards said second pulley.

5. Apparatus according to claim 1, wherein said guide means are mounted so as to be positionally adjustable towards or away from said first pulley.

6. Apparatus according to claim 5 wherein said second pulley is mounted on said arm, and said biassing means is operable to bias said arm in a direction away from said first pulley.

7. Apparatus according to claim 6 wherein said biassing means is mounted on said support structure so as to be movable with said guide means.

8. Apparatus according to claim 1 comprising a third pulley mounted for rotation about a third axis spaced from and substantially parallel with the axes of said first and second pulleys, and having a periphery which is substantially in alignment with the peripheries of said first and second pulleys, wherein said endless belt passes around the peripheries of said three pulleys.

9. Apparatus according to claim 8 wherein said pulleys are mounted on said support structure and said third pulley is mounted so as to be movable towards and away from said first and second pulleys.

10. Apparatus according to claim 9 wherein said third pulley is mounted on said arm and said biassing means is operable to bias said arm in a direction away from said first and second pulleys.

11. Apparatus according to claim 8 comprising a guide block movable towards and away from said first pulley, a second arm which is mounted on said support structure to pivot about a pivot axis and has a pivot thereon, and a link, wherein said guide means are mounted on said guide block, said second pulley is mounted on said second arm, and said link connects said guide block to said pivot on said second arm which pivot is spaced from the pivot axis of said second arm and the axis of rotation of said second pulley by distances proportional to the diameters of the first and second pulleys respectively.

12. Apparatus according to claim 1 wherein said biassing means includes adjustment means operable to adjust the tension in said endless belt.

13. Apparatus according to claim 1 comprising cam means operable to increase the force applied by said biassing means after start up of the twisting process by said apparatus.

14. Apparatus according to claim 1 comprising belt steadying means located adjacent said nip.

15. Apparatus according to claim 14 wherein said belt steadying means comprises a pin positioned, whereby said belt has an edge which contacts said pin when said belt is running but there is no contact therebetween when said belt is stationary.

16. Apparatus according to claim 2 wherein said first and second drive pulleys are toothed pulleys and said apparatus drive belt is a toothed timing belt.

17. Apparatus according to claim 2 wherein said drive shaft and said spindle have axes which extend in mutually substantially perpendicular directions and said apparatus drive belt provides two runs each of which is twisted through substantially 90°.

18. Apparatus according to claim 17 wherein said first and second drive pulleys are disposed relative to each other whereby each has a periphery and a mid-axial plane which is substantially tangential to the periphery of the other drive pulley at that side thereof at which the apparatus drive belt is disengaged therefrom.

* * * * *